US012352448B2

(12) United States Patent
Sager et al.

(10) Patent No.: US 12,352,448 B2
(45) Date of Patent: Jul. 8, 2025

(54) COMBINATION OVEN CONTROL INTERFACE

(71) Applicant: ILLINOIS TOOL WORKS INC., Glenview, IL (US)

(72) Inventors: David Sager, Troy, OH (US); Fabrice Amari, Breuilpont (FR); Hank Sawtelle, Portland, OR (US); Luc Buset, Poligny (FR); Pete Schellenbach, Baltimore, MD (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 476 days.

(21) Appl. No.: 17/847,999

(22) Filed: Jun. 23, 2022

(65) Prior Publication Data

US 2023/0417424 A1 Dec. 28, 2023

(51) Int. Cl.

| | |
|---|---|
| ***F24C 7/08*** | (2006.01) |
| ***F24C 3/12*** | (2006.01) |
| ***F24C 15/32*** | (2006.01) |

(52) U.S. Cl.

CPC ..... *F24C 15/327* (2013.01); *F24C 3/124* (2013.01); *F24C 7/08* (2013.01)

(58) Field of Classification Search

CPC ..... F24C 7/085; F24C 3/124; F24C 15/327; F24C 15/00; F24C 7/08

See application file for complete search history.

(56) References Cited

U.S. PATENT DOCUMENTS

| | | | |
|---|---|---|---|
| 4,851,644 | A | 7/1989 | Oslin |
| 4,920,948 | A | 5/1990 | Koether |
| 4,924,072 | A | 5/1990 | Oslin |
| 5,014,679 | A | 5/1991 | Childs |
| 5,619,983 | A | 4/1997 | Smith |
| 5,951,901 | A | 9/1999 | Douglas |
| 6,555,791 | B2 | 4/2003 | Lubrina |
| 6,987,246 | B2 | 1/2006 | Hansen |
| 7,060,941 | B1 | 6/2006 | Embury |
| 7,208,701 | B2 | 4/2007 | Fraccon |
| 7,875,834 | B2 | 1/2011 | Bujeau |
| 11,168,894 | B2 | 11/2021 | Sager |
| 2003/0141296 | A1 | 7/2003 | Thorneywork |
| 2004/0261632 | A1 | 12/2004 | Hansen |
| 2009/0136640 | A1 | 5/2009 | Embury |

(Continued)

FOREIGN PATENT DOCUMENTS

| | | | |
|---|---|---|---|
| DE | 20002833 | U1 | 6/2000 |
| DE | 202007010358 | U1 | 9/2007 |
| DE | 102007043371 | A1 | 4/2009 |

(Continued)

OTHER PUBLICATIONS

International Searching Authority, Search Report and Written Opinion issued in corresponding PCT/US2023/025139 mailed Sep. 8, 2023, 11 pages.

*Primary Examiner* — Alfred Basichas

(74) *Attorney, Agent, or Firm* — THOMPSON HINE LLP

(57) ABSTRACT

A combination oven control interface includes a feature for an operator to select a setpoint temperature (T); and a feature for automatically selecting at least one humidity information (101) representative of a setpoint humidity level (H %) and of a cooking mode (M), the automatic selection taking into account the selected setpoint temperature (T).

18 Claims, 3 Drawing Sheets

(56) References Cited

U.S. PATENT DOCUMENTS

| | | | | |
|---|---|---|---|---|
| 2009/0218332 | A1 | 9/2009 | Negandhi | |
| 2012/0294992 | A1* | 11/2012 | Sager | F24C 15/327<br>99/331 |

FOREIGN PATENT DOCUMENTS

| | | | |
|---|---|---|---|
| DE | 102008036683 | A1 | 2/2010 |
| EP | 3365605 | B1 | 4/2020 |
| IT | PN20090060 | A1 | 5/2003 |
| JP | 2011027273 | A | 2/2011 |
| KR | 100382280 | B1 | 5/2003 |
| KR | 20070105799 | A | 10/2007 |
| KR | 20200001311 | A | 1/2020 |
| WO | WO-2007103958 | A2 | 9/2007 |
| WO | WO-2011031958 | A1 | 3/2011 |
| WO | WO-2012162072 | A1 | 11/2012 |

* cited by examiner

COMBINATION OVEN CONTROL INTERFACE

TECHNICAL FIELD

The present invention generally relates to control interfaces for combination ovens that use several cooking technologies (for example, convection and steam or convection, steam and microwave) to transfer heat to food products, and more particularly, a combination oven that eliminates the need for a user to set a humidity setting and the cooking mode.

BACKGROUND

Food products are traditionally cooked by applying heat energy for a given time. In conventional ovens, food is cooked by heat radiated by the walls of the oven cavity or by a heat source near the surface of the food, or by natural convection. In convection ovens, heat energy is transferred to the surface of the food by convection from the heated air that moves through the oven cavity and over the surface of the food. In microwave ovens, heat is transferred by absorbing energy from the microwaves directly into the mass of the food. In steam ovens, heat is transferred by the condensation of the steam on the surface of the food.

In combination ovens, more than one heat transfer process is used to reduce cooking time or improve the taste, texture, water content or visual appearance of the cooked food. In a combined steam and convection mode, moisture is delivered in the oven during cooking. Typical combination ovens have complex controls that require the user to choose between preset "Convection", "Mixed" and "Steam" cooking modes, as well as to manually set the desired humidity level, either directly or as part of a cooking program (for example, a recipe). Users, some of whom have only used household or convection ovens, where only the temperature needs to be set, tend to avoid complex controls and do not understand the complexity of the humidity level, natural or forced, in such a cooking chamber. As a result, many combination ovens are not optimally used and are simply used like basic ovens, manually, without taking advantage of the automation capabilities provided by modern controls and sensors.

It would thus be advantageous to obtain a control interface that allows users to easily take advantage of the temperature-only setting in order to make the oven as easy as possible to use.

SUMMARY

On the basis of the aforementioned problems, the present invention relates to a combination oven control interface comprising:

means for an operator to select a setpoint temperature;

means for automatically selecting at least one humidity information representative of a setpoint humidity level and of a cooking mode, said automatic selection taking into account the selected setpoint temperature.

For the avoidance of doubt, all the features described herein also apply to any aspect of the invention.

Preferentially, the means for selecting a setpoint temperature comprise, for example, a field in which the user can enter the desired setpoint temperature.

Preferentially, the means for automatically selecting at least one humidity information representative of a setpoint humidity level and of a cooking mode comprise an electronic program, for example, a computer program that is previously stored in a memory of a microprocessor present in the combination oven. For example, the electronic program selects or determines, based on the setpoint temperature selected, a humidity information representative of a setpoint humidity level and a cooking mode. For example, the computer program then displays the selected or determined humidity information and the selected or determined cooking mode for the operator on the control interface.

Thus, according to the invention, with the selection of a setpoint temperature, the operator automatically receives a suggestion from the combination oven not only of humidity information but also of a cooking mode. Therefore, it is easier for the operator to obtain a predefined humidity information (for example, a setpoint humidity level) for a particular selected setpoint temperature that is, for example, a setpoint humidity level preferably for that setpoint temperature (for example, from experience, it is known that at a temperature of close to 100° C., it is highly likely that the operator will want to initiate a steam cooking operation. Moreover, at a very high temperature, for example 250° C., it is very likely that the operator would like to start a dry cooking operation). Moreover, the combination oven suggests to the operator a cooking mode obtained by the combination oven from the setpoint temperature selected by the operator. According to one embodiment of the invention, the combination oven suggests to the operator a cooking mode obtained by the combination oven from the setpoint temperature selected by the operator and from the setpoint humidity level selected by the combination oven. This makes it much easier for the operator to control the combination oven, as the operator no longer has to worry about the correspondence between the humidity information or the setpoint humidity level (which is selected by the oven) and the type of cooking (and especially the cooking mode) that the operator wants to start. Thus, the invention makes it possible to reduce the complexity of the information to be managed or taken into account by the operator, due to the automatic selection by the control interface of the humidity information (for example, the setpoint humidity level) and the cooking mode. Since a given combination oven will typically be operated by many operators with differing technical knowledge, this simplification, by the invention, of the information to be managed is of great value for the operability of the combination oven.

According to one embodiment of the invention, the combination oven control interface comprises means of displaying the setpoint temperature, humidity information and cooking mode.

According to one embodiment of the invention, the combination oven control interface comprises means of displaying a measured value of the temperature in the oven and/or of a calculated value of a setpoint humidity level in the oven.

Indeed, according to one embodiment of the invention, from the operator's selection of a setpoint temperature, the control interface can calculate or determine, for example, by a linear (for example, a rule of three) or non-linear approximation, a calculated value of a setpoint humidity level in the oven.

According to one embodiment of the invention, the display means comprise a display screen and preferentially a touch screen.

According to one embodiment of the invention, the display means make it possible to display the following information on the display screen in a representative arrangement in the following order: the setpoint temperature, then the humidity information and/or the cooking mode.

According to one embodiment of the invention, the display means make it possible to display the following information on the display screen from the top to the bottom of the display screen: the setpoint temperature, then the humidity information and/or the cooking mode.

According to one embodiment of the invention, the display means make it possible to display the following information on the display screen from the top to the bottom of the display screen: the setpoint temperature, then the humidity information, then the cooking mode.

Thus, due to such an organization of the display from the top to the bottom of the display screen, a display screen that is higher than it is wide can be used. In addition, such an arrangement of the display from the top to the bottom of the display screen corresponds to an optimal use of the space on the interface display screen. Lastly, such a top-down display arrangement on the display screen corresponds to the natural tendency of the user or the operator of the oven or of the interface to read from the top to the bottom. Thus, the interface display is arranged according to the user's preference: the user first thinks about the setpoint temperature to be entered, the humidity information and the cooking mode whose values are selected by the interface are displayed below and therefore subsequently in the user's reading direction.

According to one embodiment of the invention, the display means make it possible to display information indicating that the automatic selection means are activated, hereafter "automatic selection information". Thus, for example, the display means enable a logo to be displayed on the display screen bearing, for example, the letter A (for automatic) which allows the user to clearly see that the oven is in an operating mode corresponding to the activation of the automatic selection means (operating mode which can be called automatic or normal operation mode).

According to one embodiment of the invention, the cooking mode is at least one of the following cooking modes:

- a first convection cooking mode (CONVECTION) corresponding to a setpoint humidity level (H %) defined by a first value range: 0%<=H %<=A %;
- a second cooking mode (COMBI) corresponding to a setpoint humidity level (H %) defined by a second value range: A %<H %<=B %;
- a third steam cooking mode (STEAM) corresponding to a setpoint humidity level (H %) defined by a third value range: H %>B %, and in that A<B.

According to one embodiment of the invention, A is comprised between 30% and 60% and B is comprised between 80% and 99%.

According to one embodiment of the invention, the automatic selection means take into account a pre-established correspondence between setpoint temperature values and setpoint humidity level values and one or more cooking modes.

According to one embodiment of the invention, said pre-established correspondence is saved in an electronic memory. According to one embodiment of the invention, said electronic memory is comprised in the combination oven. According to another embodiment of the invention, said electronic memory is comprised in the control interface.

According to one embodiment of the invention, the control interface comprises means for switching the interface to a first forced mode of operation in which the user can choose a forced humidity level value.

According to one embodiment of the invention, if the value of the forced humidity level corresponds to the third cooking mode (STEAM), then the setpoint temperature is forced by the control interface to a saturated steam temperature.

According to one embodiment of the invention, the control interface comprises means for switching the interface to a second forced mode of operation in which the user can choose a forced cooking mode.

According to one embodiment of the invention, if the value of the forced cooking mode corresponds to the third cooking mode (STEAM), then the setpoint temperature is forced by the control interface to a saturated steam temperature.

According to one embodiment of the invention, the control interface comprises reset means for switching from one of said forced operating modes to a normal operating mode in which the automatic selection means is activated.

The invention also relates to a combination oven comprising a control interface as described above.

The invention also relates to a method for controlling a combination oven comprising the following steps:

- selection, by an operator, of a setpoint temperature
- automatic selection of at least one humidity information representative of a setpoint humidity level and of a cooking mode, said automatic selection taking into account the selected setpoint temperature.

As part of this application, it is expressly provided that the various aspects, embodiments, examples and alternatives disclosed in the preceding paragraphs, in the claims and/or in the following description and drawings, and in particular the individual features thereof, may be taken separately or in any combination. In other words, all embodiments and/or features of any embodiment may be combined in any way, unless these features are incompatible.

For the avoidance of doubt, the terms "can", "and/or", "for example", and any other similar term used herein must be interpreted as not limiting, such that any feature described herein is not necessarily required to be present. Indeed, any combination of optional features is expressly foreseen without departing from the scope of the invention, whether or not they are expressly claimed. The applicant reserves the right to amend any claim originally filed or to file any new claim accordingly, including the right to amend any claim originally filed to depend on and/or incorporate any feature of any other claim, though it is not originally claimed in this manner.

BRIEF DESCRIPTION OF THE DRAWINGS

Other features and advantages of the invention will become apparent from the following detailed description, which will be understood in reference to the appended drawings, in which.

DETAILED DESCRIPTION

Different aspects of different embodiments according to the invention are described in more detail below, in reference to the accompanying drawings.

Throughout the description and claims of this specification, the words "comprise" and "contain" and their variations mean "including but not limited to" and are not intended for (and do not exclude) other parts, additives, components, integers or steps. Throughout the description and claims of this specification, the singular includes the plural, unless the context requires otherwise. In particular, when the indefinite article is used, the description should be understood to include the plural as well as the singular, unless the context requires otherwise.

Figure 1:
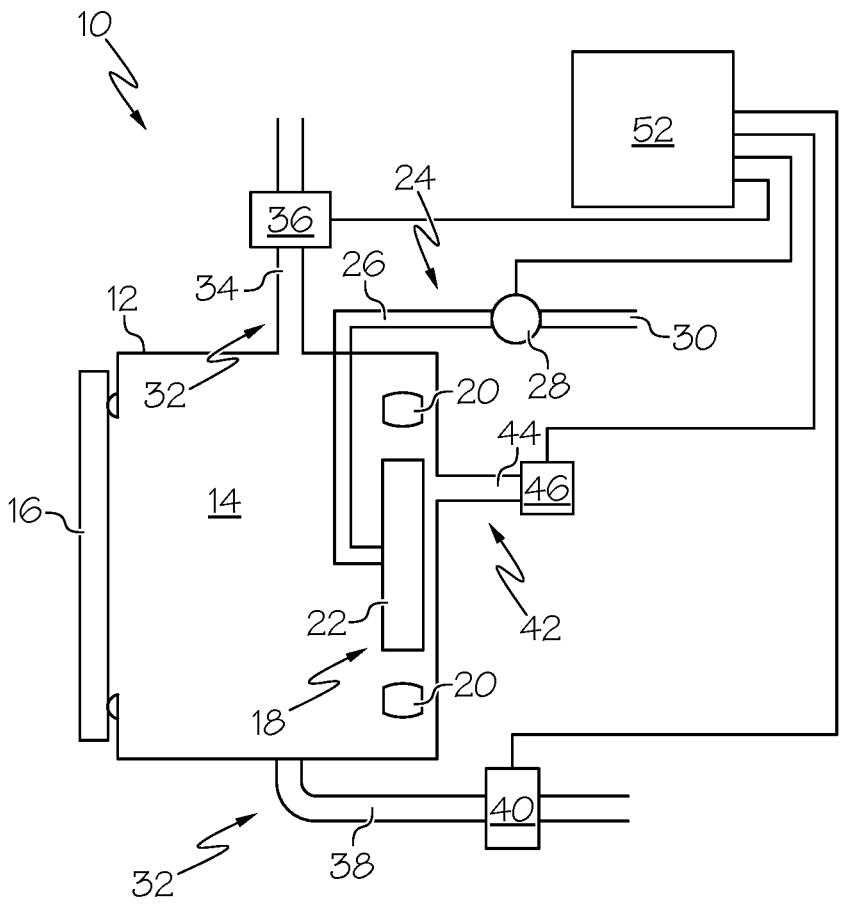
FIG. 1 schematically shows a combination oven in which a control interface can be used according to one embodiment of the invention.
Figure 2:
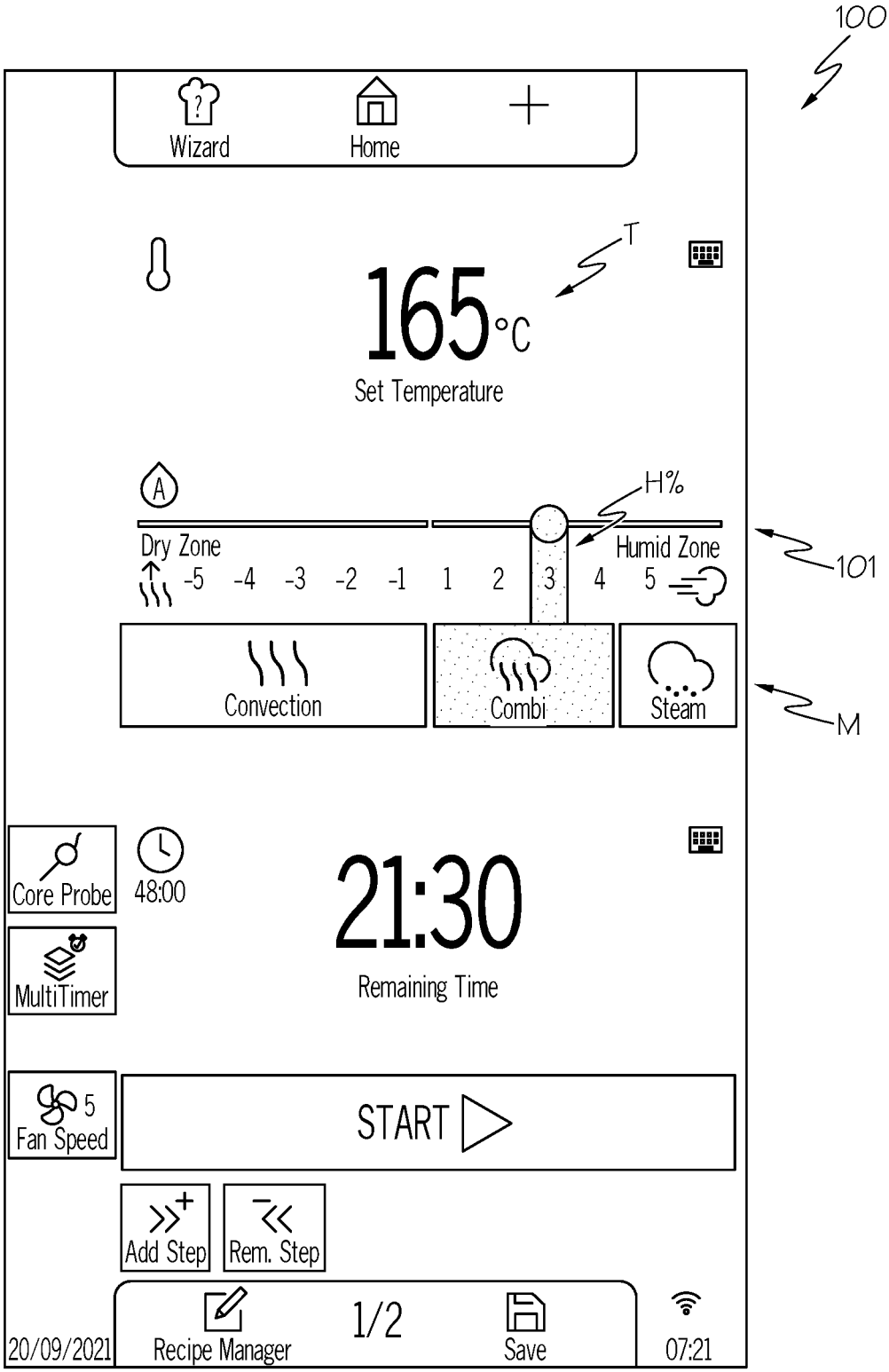
FIG. 2 schematically shows a schematic representation of a combination oven control interface according to one embodiment of the present invention.
Figure 3:
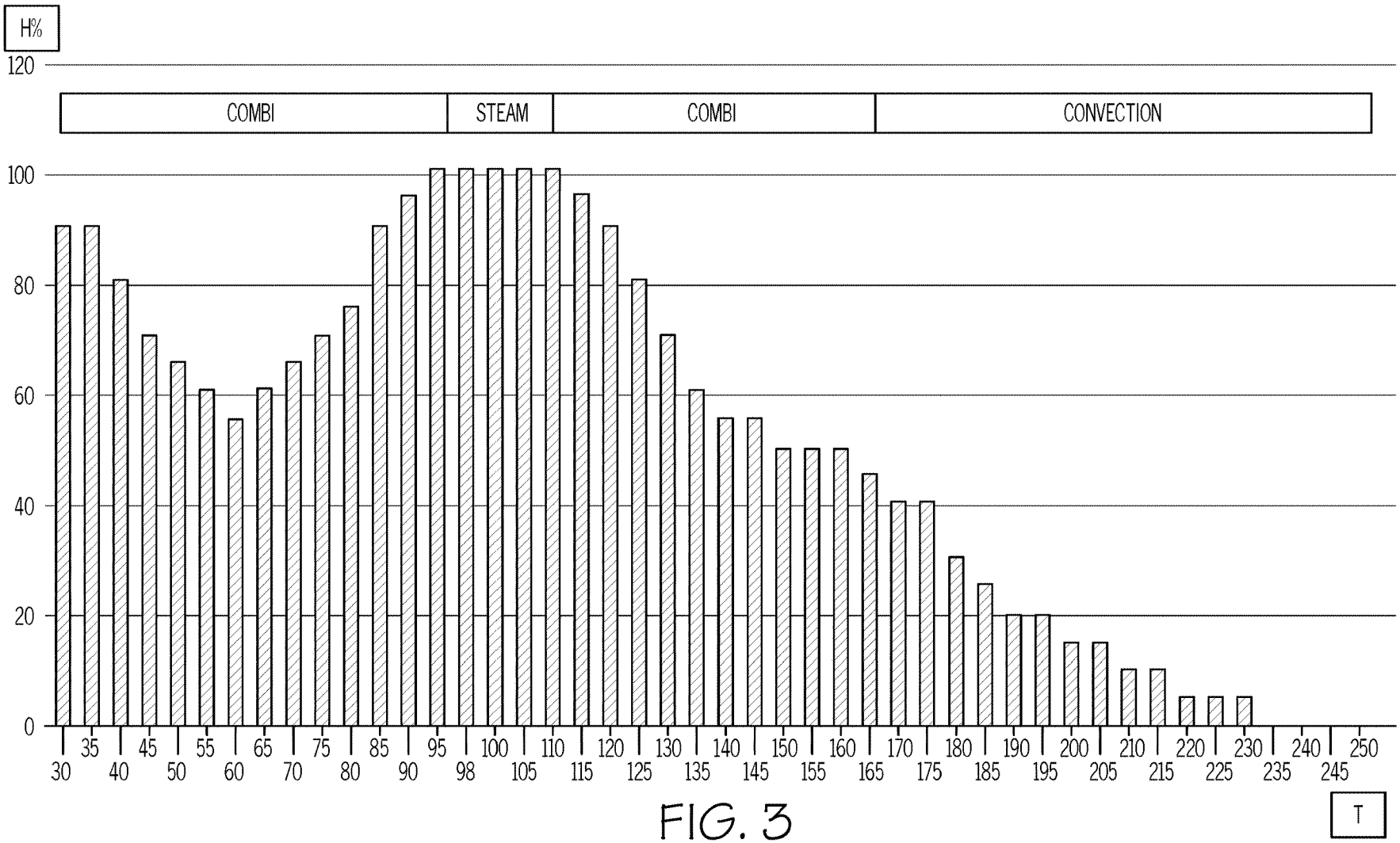
FIG. 3 shows a graph illustrating a typical profile of the temperature-humidity-cooking method.

In relation to FIGS. 1 to 3, we will now describe an embodiment of a combination oven control interface according to the invention.

FIG. 1 schematically shows a combination oven as described in relation to FIG. 1 of patent document WO2012162072. Referring to FIG. 1, a schematic representation of a basic combination oven construction 10 is shown, comprising a housing 12 defining a cooking cavity 14 that is accessible by an oven door 16 that can be moved between open and closed positions. A convection cooking system 18 may be formed by one or more heating elements 20 arranged around or along a circulation fan 22. The elements 20 may, for example, be resistive heating elements or heat exchange tubes through which the hot combustion gases flow. Although in the illustrated embodiment the heating elements and the fan are located along a rear wall of the oven cavity, it is acknowledged that variations are possible. For example, the heating elements and the fan could be located along a top, bottom or side wall, one or both heating elements and/or the fan could be located outside the cooking cavity itself (with airflow pathways to deliver air into and out of the cavity from the location of the fan and/or the heating elements) or the heating elements could be arranged in front of or behind the fan. U.S. Pat. No. 7,875,834, also discloses various other potential embodiments for convection cooking systems in an oven.

FIG. 2 shows a schematic representation of a control interface 100 of a combination oven according to one embodiment of the present invention. The control interface 100 can be incorporated into the combination oven 10.

FIG. 3 illustrates a graph showing a temperature-humidity-cooking mode-type profile enabling the automatic selection of a humidity level (H %) and of a cooking mode (M).

Humidity (H %) is a complex concept for the user to grasp, as humidity can change with temperature. The humidity level can be artificially applied by adding steam to the oven (for example in "Combi" mode and in "Steam" mode as described hereafter.) Humidity can also be naturally generated by products. Also, setting a humidity setpoint may cause the equipment to perform a humidification or dehumidification function.

According to the present invention, and as further described hereafter, it is proposed that the user could have a better grasp of the notion of humidity, for example, by means of a display screen on a control interface 100. Thus, the display screen may comprise user-comprehensive zones that may, for example, be a dry zone and a wet zone. It may also allow the user to better associate a setpoint humidity level value with a cooking mode (as explained below) by implementing a simple setting on a scale (101), for example comprising positions ranging from −5 to +5. For example, such positions correspond to setpoint humidity levels and suggest that the user increase or decrease the humidity.

Of course, for experienced experts or users, the setting can be proposed in % of setpoint humidity, between a minimum attainable humidity and a maximum attainable humidity, for example 5% to 100%.

This scale (101) is separated into a so-called dry zone corresponding to a setpoint humidity level (H %) of 0% to a substantially median value, for example 45%, and a so-called wet zone corresponding to a setpoint humidity level (H %) of this median value 45% to a maximum value, for example a setpoint humidity level (H %) of 100%.

It should be noted that this scale is supplemented by "Dry" position preceding the dry zone. This manually accessible dry zone, in which the setpoint humidity level H % is no longer taken into account, enables continuous dehumidification to be activated in order to dry out the atmosphere and the product.

As shown in FIG. 2, the present invention relates to a control interface 100 for a combination oven 10 comprising:

- means (for example, manual means) for an operator to select a setpoint temperature (T);
- automatic means for selecting at least one humidity information 101 representative of a setpoint humidity level H % and of a cooking mode M. For example, the automatic selection takes into account the selected setpoint temperature T. Also as an example, the automatic selection is only dependent on the user choosing the setpoint temperature T.

For example, the humidity information 101 representative of a setpoint humidity level H % is a set of values (each corresponding to a humidity level H %) arranged on a scale, for example ranging from −5 to 5.

The selection means is described more fully below.

The control interface 100 may also comprise means 100, for example a graphical user interface comprising a touch screen, of displaying the setpoint temperature T, the humidity information 101 (for example, the scale mentioned above), and the cooking mode M.

Moreover, the control interface 100 may also comprise display means (for example, on the touch screen) of a measured temperature value in the oven and/or a calculated value of the setpoint humidity level in the oven.

According to one embodiment of the invention, from the operator's selection of a setpoint temperature, the control interface can calculate or determine, for example by a linear (for example, a rule of three) or non-linear approximation, a calculated value of a setpoint humidity level in the oven. Indeed, for example, in the profile in FIG. 3, a value of the given specific setpoint temperature, may—in the profile—not have an exact corresponding setpoint humidity level but only two setpoint humidity level values closest to the correspondence. In this case, the control interface may, for example, implement a linear approximation (between the two closest setpoint humidity level values) to calculate a setpoint humidity level value corresponding to the setpoint temperature.

For example, the heating mode M is at least one of the following heating functions:

- a first convection cooking mode CONVECTION corresponding to a setpoint humidity level H % defined by a first value range: 0%<=H %<=A %;
- a second cooking mode COMBI corresponding to a setpoint humidity level H % defined by a second value range: A %<H %<=B %;
- a third steam cooking mode STEAM corresponding to a setpoint humidity level H % defined by a third value range: H %>B %, and in that A<B.

For example, A is comprised between 30% and 60% and B is comprised between 80% and 99%.

As another example, A=45% and B=95% and in this case:

- the first convection cooking mode CONVECTION corresponds to a dry zone, for example, this corresponds to the −5 to −1 positions on the scale (which corresponds to a range of setpoint humidity level values (H %) of from 0% to 45%. For example, this mode accepts humidity naturally generated by the products and may also regulate it through occasional dehumidification.

the second cooking mode COMBI corresponds to a wet zone, for example, this corresponds to positions +1 to +4 on the scale (which corresponds to a range of H % setpoint humidity values of from 45% to 95%). In addition, this mode allows the chamber to be humidified.

The third STEAM mode corresponds to the extreme of a humid zone, for example, this corresponds to position +5 on the scale (which corresponds to a range of values for the setpoint humidity H % of from 95% to 100%). This mode ensures steam saturation around 100° C.

For example, the second cooking mode COMBI may be different from the first cooking mode CONVECTION by forcing the humidity level to rise.

According to a preferred aspect of the invention, the display means are adapted to display on a display screen (for example, a touch screen), for example but not limitatively, from the top of the screen to the bottom of the screen, in the following order: the setpoint temperature (main criterion entered), the position on the scale corresponding to the setpoint humidity level (automatically proposed according to the temperature) and the cooking mode (corresponding to the position on the humidity scale).

Thus, due to the invention, the operator is able to have access to all the information necessary to carry out a type of cooking on the basis of the sole temperature information. This makes ovens of this type, better known as combi ovens, accessible to users who have never used them, or who have no experience in choosing a heating method, much less a humidity level. The present invention also makes it possible to limit operator cooking errors, for example by indicating when the humidity is too low for a high temperature.

For example, the control interface's automatic selection means take into account a pre-established correspondence between setpoint temperature values and setpoint humidity level values and one or more cooking modes.

For example, the pre-established correspondence is saved in an electronic memory, the electronic memory being preferentially comprised in the combination oven.

For example, the automatic selection means take into account or use Table 1 below to achieve this correspondence.

Thus, the automatic selection means may use a setpoint temperature correspondence curve depending on the setpoint humidity level and the cooking mode, the curve being potentially predetermined based on experience, as shown in FIG. 3.

In this FIG. 3, there are several zones, each zone corresponds to a mode and a plurality of possible temperature and humidity levels.

As a non-limiting example, the automatic selection of the setpoint humidity level and of the cooking mode is a function of the following zones, based solely on the setpoint temperature information T (here in degrees Celsius) entered by the operator.

Table 1 below illustrates the correspondence used by the control interface's automatic selection means between the setpoint temperature T, the setpoint humidity level H % and the cooking mode.

TABLE 1

| T (° C.) | H % | Mode |
|---|---|---|
| 30 | 90% | COMBI |
| 35 | 90% | COMBI |
| 40 | 80% | COMBI |
| 45 | 70% | COMBI |
| 50 | 65% | COMBI |
| 55 | 60% | COMBI |
| 60 | 55% | COMBI |
| 65 | 60% | COMBI |
| 70 | 65% | COMBI |
| 75 | 70% | COMBI |
| 80 | 75% | COMBI |
| 85 | 90% | COMBI |
| 90 | 95% | STEAM |
| 95 | 100% | STEAM |
| 98 | 100% | STEAM |
| 100 | 100% | STEAM |
| 105 | 100% | STEAM |
| 110 | 100% | STEAM |
| 115 | 95% | COMBI |
| 120 | 90% | COMBI |
| 125 | 80% | COMBI |
| 130 | 70% | COMBI |
| 135 | 60% | COMBI |
| 140 | 55% | COMBI |
| 145 | 55% | COMBI |
| 150 | 50% | COMBI |
| 155 | 50% | COMBI |
| 160 | 50% | COMBI |
| 165 | 45% | COMBI |
| 170 | 40% | CONVECTION |
| 175 | 40% | CONVECTION |
| 180 | 30% | CONVECTION |
| 185 | 25% | CONVECTION |
| 190 | 20% | CONVECTION |
| 195 | 20% | CONVECTION |
| 200 | 15% | CONVECTION |
| 205 | 15% | CONVECTION |
| 210 | 10% | CONVECTION |
| 215 | 10% | CONVECTION |
| 220 | 5% | CONVECTION |
| 225 | 5% | CONVECTION |
| 230 | 5% | CONVECTION |
| 235 | 0% | CONVECTION |
| 240 | 0% | CONVECTION |
| 245 | 0% | CONVECTION |
| 250 | 0% | CONVECTION |

According to a preferred aspect of the invention, the oven control interface may also comprise means for switching the interface into a first forced mode of operation in which the user may choose a forced humidity level value (H % C). For example, if the forced humidity value corresponds to the third cooking mode (STEAM), then the setpoint temperature (T) is forced by the control interface to the saturated steam temperature.

According to a preferred aspect of the invention, the oven control interface may also comprise means for switching the interface to a first forced mode of operation in which the user may choose a forced humidity level value (H % C). For example, if the forced cooking mode corresponds to the third cooking mode (STEAM), then the setpoint temperature (T) is forced by the control interface to the saturated steam temperature.

According to the invention, the combination oven control interface may comprise reset means for switching from one of said forced operating modes to a normal operating mode in which the automatic selection means is activated.

The combination oven control interface may also comprise means for forcing the application of the setpoint humidity (H %) defined by the setpoint temperature (T) so as to allow the operator to force, by means of the humidity scale (101), the application of a forced humidity value (H % C) while maintaining the setpoint temperature (T) if the forced humidity value (H % C) corresponds to one of the first cooking mode and the second cooking mode (CONVECTION; COMBI).

According to an variant in accordance with the present invention, if the position of the scale and the setpoint humidity (H %) corresponds to the third steam cooking mode (STEAM), then the setpoint temperature (T) initially set by the operator can be forced to a cooking temperature value corresponding to a saturated steam value.

Also, the combination oven may comprise means for forcing the mode (M) defined by the setpoint temperature (T) so as to allow the operator to force the application of a forced mode (M) while maintaining the setpoint temperature (T) and changing the position on the humidity scale in accordance with the chosen mode and therefore the setpoint humidity level (H %), if the forced mode is one of the first cooking mode and the second cooking mode (CONVECTION; COMBI)

In addition, for example, if the forced cooking mode is of the third steam cooking mode (STEAM) type, then the setpoint temperature (T) initially set by the operator can be forced to a cooking temperature value corresponding to the saturated steam value.

According to a variant in accordance with the present invention, the combination oven of the present invention also comprises reset means for switching from a forced mode to an automatic mode defined by the setpoint temperature (T) entered by the operator, as well as means for displaying the actual current value for the measured temperature or humidity level. For example, pressing (for example, a short press) the Humidity icon (H %) switches the user from forced to automatic mode. Then, a long press on the setpoint Temperature (T) or setpoint Humidity (H %) icons on the display enables the actual values to be entered for a predetermined amount of time, for example five seconds.

For example, the display means make it possible to display information indicating that the automatic selection means are activated, hereafter "automatic selection information". This corresponds, for example, to the normal or automatic operation mode.

LIST OF REFERENCE SIGNS

T setpoint temperature
H % setpoint humidity
M cooking mode
DRY drying position
CONVECTION first cooking mode
COMBI second cooking mode
STEAM third cooking mode
100 display means
101 humidity scale

The invention claimed is:

1. A combination oven control interface, comprising:
means for an operator to select a setpoint temperature;
means for automatically selecting at least one humidity information representative of both a setpoint humidity level and of a cooking mode, said automatic selection taking into account the selected setpoint temperature, wherein the means for automatically selecting is configured such that:
the cooking mode is a steam cooking mode in the case of the selected setpoint temperature being a first temperature;
the cooking mode is a convection cooking mode in the case of the selected setpoint temperature being a second temperature; and
the cooking mode is a combination steam and convection cooking mode in the case of the selected setpoint temperature being a third temperature.

2. The combination oven control interface according to claim 1, further comprising means of displaying each of the setpoint temperature, the humidity information and the applicable one of the steam cooking mode, the convection cooking mode or the combination steam and convection cooking mode.

3. The combination oven control interface according to claim 2, further comprising means of displaying a measured value of the temperature in the oven and/or of a calculated value of the setpoint humidity level in the oven.

4. The combination oven control interface according to claim 2, wherein the means of displaying comprises a display screen.

5. The combination oven control interface according to claim 4, wherein the means of displaying is configured to display the following information on the display screen in a representative arrangement in the following order: the setpoint temperature, then the humidity information, then the applicable one of the steam cooking mode, the convection cooking mode or the combination steam and convection cooking mode.

6. The combination oven control interface according to claim 1, wherein the means of displaying is configured to display information indicating that the means for automatically selecting are activated.

7. The combination oven control interface according to claim 1, wherein:
the convection cooking mode corresponds to a setpoint humidity level defined by a first value range between 0% and A %;
the combination steam and convection cooking mode corresponds to a setpoint humidity level defined by a second value range between A % and B %;
the steam cooking mode corresponds to a setpoint humidity level defined by a third value range that is higher than B %, and
where A<B.

8. The combination oven control interface according to claim 7, characterized in that A % is between 30% and 60% and B % is between 80% and 99%.

9. The combination oven control interface according to claim 1, wherein the means for automatically selecting is configured to take into account a pre-established correspondence between setpoint temperature values and setpoint humidity level values and the steam, convection and combination steam and convection cooking modes.

10. The combination oven control interface according to claim 9, wherein said pre-established correspondence is saved in an electronic memory in the combination oven.

11. The combination oven control interface according to claim 1, further comprising means for switching the interface to a first forced mode of operation in which the user can choose a forced humidity level value.

12. The combination oven control interface according to claim 11, wherein, if the forced humidity value corresponds to the steam cooking mode, then the setpoint temperature is forced by the control interface to a saturated steam temperature.

13. The combination oven control interface according to claim 11, further comprising means for switching the interface to a second forced mode of operation in which the user can choose a forced cooking mode.

14. The combination oven control interface according to claim 13, wherein, if the forced cooking mode corresponds to the steam cooking mode, then the setpoint temperature is forced by the control interface to a saturated steam temperature.

15. The combination oven control interface according to claim 11, further comprising reset means for switching from one of said forced operating modes to a normal operating mode in which the means for automatically selecting is activated.

16. A combination oven, comprising a cooking cavity and a control interface according to claim 1.

17. A method of controlling a combination oven, comprising:

selection, by an operator, of a setpoint temperature;

the combination oven carrying out an automatic selection of at least one humidity information representative of a setpoint humidity level and of a cooking mode, said automatic selection taking into account the selected setpoint temperature such that the cooking mode can be any one of a steam cooking mode, a convection cooking mode, or a combination steam and convection cooking mode, depending upon the selected setpoint temperature.

18. A combination oven control interface, comprising:

means for an operator to select a setpoint temperature;

means for automatically selecting at least one humidity information representative of both a setpoint humidity level and of a cooking mode, said automatic selection taking into account the selected setpoint temperature, wherein the means for automatically selecting is configured such that:

the cooking mode is a steam cooking mode in the case of the selected setpoint temperature being in a first temperature range;

the cooking mode is a convection cooking mode in the case of the selected setpoint temperature being in a second temperature range; and the cooking mode is a combination steam and convection cooking mode in the case of the selected setpoint temperature being in a third temperature range.

* * * * *